US006121728A

United States Patent [19]

Kikuchihara et al.

[11] Patent Number: 6,121,728

[45] Date of Patent: Sep. 19, 2000

[54] FLUORESCENT LAMP HAVING THE CATHODE AND ANODE WITH PARTICULAR ANGULAR ARRANGEMENT

[75] Inventors: Kouji Kikuchihara; Hisataka Kondo; Tsuneyoshi Shibasaki, all of Iwaki, Japan

[73] Assignee: Stanley Electric Co., Ltd., Tokyo, Japan

[21] Appl. No.: 09/238,418

[22] Filed: Jan. 28, 1999

[30] Foreign Application Priority Data

Jan. 29, 1998 [JP] Japan ..... 10-017127

[51] Int. Cl.[7] ..... H01J 17/18; H01J 61/36

[52] U.S. Cl. ..... 313/623; 313/491; 313/492; 313/632; 313/631

[58] Field of Search ..... 313/491, 492, 313/311, 310, 623, 625, 632, 633, 341, 346 R

[56] References Cited

U.S. PATENT DOCUMENTS

| | | | |
|---|---|---|---|
| 2,403,184 | 7/1946 | Lemmers | 313/491 |
| 3,369,143 | 2/1968 | Etal et al. | 313/491 |
| 4,962,334 | 10/1990 | Godyak | 313/632 |
| 5,049,785 | 9/1991 | Shaffer | 313/492 |
| 5,298,834 | 3/1994 | Oda et al. | 313/631 |
| 5,932,970 | 8/1999 | Chiba et al. | 313/623 |

FOREIGN PATENT DOCUMENTS

| | | |
|---|---|---|
| 0838833 A2 | 4/1998 | European Pat. Off. . |
| 5-21255 | 5/1993 | Japan . |

*Primary Examiner*—Michael H. Day
*Assistant Examiner*—Mariceli Santiago
*Attorney, Agent, or Firm*—Morgan, Lewis & Bockius LLP

[57] ABSTRACT

A fluorescent lamp includes a bulb, a fluorescent material coated on an internal surface of the bulb, a stem, a discharge chamber filled with gas and mercury, a thermal cathode filament coated with electron emitting material, an anode, a pair of lead wires passing air-tightly through the stem and supporting the thermal cathode filament, and a lead wire supporting the anode. The anode is a substantially rectangular plate, and is substantially parallel to the thermal cathode filament in a cross sectional view taken along a bulb axis Z. The thermal cathode filament and the rectangular anode plate can be configured of an angle range of 30–60 degrees in a cross sectional view perpendicular to the lamp axis Z. The rectangular anode plate and the lead wire supporting the anode can be attached to each other in a substantially flag-shaped configuration. The invention produces a smaller discharge spot to improve thermal electron emission efficiency such that efficiency of the fluorescent lamp is improved. Furthermore, over-all size reduction of a fluorescent lamp is possible.

10 Claims, 3 Drawing Sheets

FLUORESCENT LAMP HAVING THE CATHODE AND ANODE WITH PARTICULAR ANGULAR ARRANGEMENT

This invention claims the benefit of Japanese Patent Application No. 10-17127, filed on Jan. 29, 1998, which is hereby incorporated by reference.

BACKGROUND OF THE INVENTION

1. Field of the Invention

The present invention relates to a lamp and more particularly to a single ended subminiature fluorescent lamp in which power supply terminals are preferably arranged on only one end of a bulb and wherein the bulb has the same shape as a typical halogen lamp used as a signal light.

2. Description of the Related Art

FIG. 5 is a cross sectional view taken along lamp axis Z of a related art fluorescent lamp 90. FIG. 6 is another cross sectional view of the related art lamp taken along line B—B of FIG. 5. The related art fluorescent lamp 90 includes: a bulb 94; fluorescent material 94*a* coated on an internal surface of the bulb 94; a stem 91; a discharge chamber 94*b* filled with gas and mercury; lead wires 91*a*, 91*a*', 91*a*" passing air-tightly through the stem 91; a thermal cathode filament 92 supported by the lead wires 91*a* and 91*a*'; an electron emitting material 92*a* coated on the thermal cathode filament 92; and a ring-like anode 93 supported by the lead wire 91*a*". At startup of the related art fluorescent lamp 90, a DC voltage of 5 V is applied between the lead wire 91*a* and the lead wire 91*a*' and thermal electrons are emitted. Then, a DC voltage of 24V is applied between the thermal cathode filament 92 and the ring-like anode 93, causing the thermal electrons emitted from the thermal cathode filament 92 to be directed to the ring-like anode 93 such that discharge starts, the fluorescent material 94*a* is excited, and light is emitted. The related art fluorescent lamp 90 has several drawbacks and problems. First, converting efficiency from wattage to luminance of the related art fluorescent lamp 90 is approximately 3.7 lm/W. This converting efficiency results in a light quantity that is enough to use as a signal light, but is not enough for use as a back-light for a liquid crystal display.

Second, as shown in FIG. 7, discharge should normally occur between the ring-like anode 93 and a grounded end S of the thermal cathode filament 92. However, in the related art florescent lamp 90, discharge spot P on the grounded end S moves towards end U of the positive side of the thermal cathode as lighting time passes due to deterioration of the electron emitting material 92*a*. When a DC voltage of 5 V is applied to the thermal cathode filament 92, the discharge spot P on the thermal cathode filament 92 moves to center point T of the thermal cathode filament 92. Center point T has a voltage that is approximately 2.5V higher than the voltage at the grounded cathode end S. In other words, electric potential between the thermal cathode filament 92 and the ring-like anode 93 decreases approximately 2.5 V. Thus, the discharge current is decreased and luminance of the subminiature fluorescent lamp 90 is also decreased. Furthermore, when the discharge spot P passes the center point T of the thermal cathode filament 92 and further moves toward the positive side of the end U of the thermal cathode, the luminance of the fluorescent lamp 90 greatly decreases as shown in line BO of FIG. 3. This decrease in luminance is a result of the discharge distance between the discharge spot P and the ring-like anode 93 increasing in addition to voltage decreasing between the thermal cathode filament 92 and the ring-like anode 93.

Third, the anode 93 has a hollow interior, and the interior space is filled with a getter material and mercury alloy. Therefore, design of the fluorescent lamp 1 is limited by dimensional requirements. Moreover, it is impossible to decrease the external diameter of the fluorescent lamp to less than 4 mm.

SUMMARY OF THE INVENTION

The invention is directed to a fluorescent lamp that substantially obviates one or more of the above problems which are a result of the limitations and disadvantages of the related art.

An object of the invention is to provide a fluorescent lamp having higher luminance such that it can be used as a back-light for a liquid crystal display.

Another object of the invention is to provide a fluorescent lamp in which high luminance is maintained even after the discharge spot passes the center point of the thermal cathode filament.

Still another object of the invention is to provide a fluorescent lamp having an external diameter of less than 4 mm.

According to an aspect of the invention, the above objects are achieved by providing a fluorescent lamp including a bulb having an internal surface defining a discharge chamber and a fluorescent material coated on the internal surface of the bulb. A stem can be located in the bulb and filled with gas and mercury and a thermal cathode filament coated with electron emitting material can be supported in the discharge chamber by a pair of lead wires. An anode can also be supported in the discharge chamber by an anode lead wire, wherein the anode is a substantially rectangular plate, and one side of the rectangular anode plate is parallel to a plane including the thermal cathode filament. The thermal cathode filament and the rectangular anode can be arranged in a rotated position relative to each other within an angle range of 30–60 degrees on a parallel flat surface, and the rectangular anode plate and the anode lead wire can be attached to each other and configured in a substantially flag-shape. An upper end of the anode lead wire can be located on the rectangular anode plate such that it does not exceed an upper end of a side of the rectangular anode which faces the thermal cathode filament, and does not project into the discharge chamber toward the thermal cathode filament.

In accordance with another aspect of the invention, a lamp includes a bulb having a top portion, a base portion and an internal surface defining a discharge chamber. A stem can be located at the base portion of said bulb and a thermal cathode located in the discharge chamber and supported by a first cathode lead wire. An anode located in the discharge chamber can be supported by an anode lead wire, wherein the anode has one side that is parallel to a plane including the thermal cathode, and the thermal cathode and the anode are positioned at an acute angle with respect to each other when viewed from the top portion of the bulb. In addition, the anode and the anode lead wire can be connected together such that the anode lead wire has an upper end that terminates prior to exceeding an upper side of the anode which faces the thermal cathode.

In yet another aspect of the invention, a method is disclosed for making a lamp in which the lamp includes a bulb having a top portion and a bottom portion, a stem located in the bottom portion, a thermal cathode supported by a cathode lead extending from the bottom portion of the bulb, and an anode supported by an anode lead extending from the bottom portion of the bulb. The method includes attaching the thermal cathode to the cathode lead extending from the bottom portion of the bulb and attaching the anode to the anode lead extending from the bottom portion of the bulb such that, when viewed from the top portion of the bulb, the anode is at an acute angle with respect to the thermal cathode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
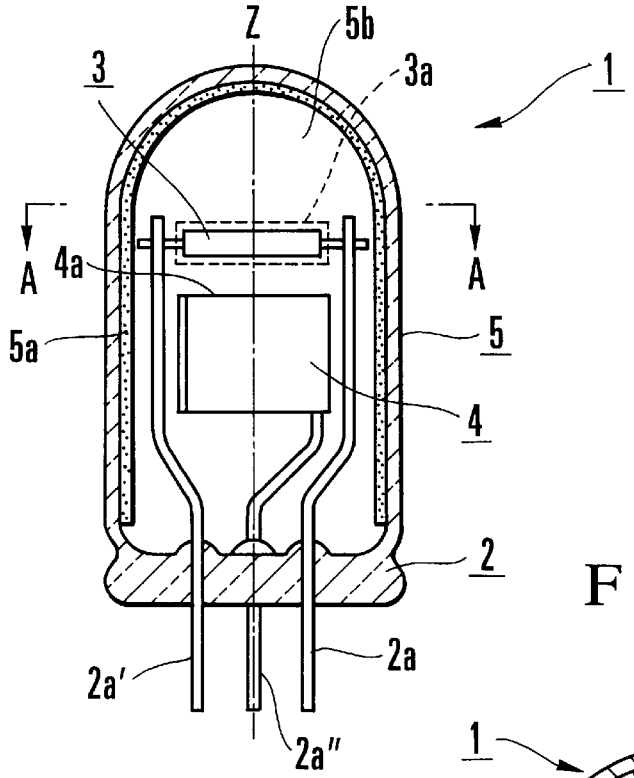
FIG. 1 illustrates a cross sectional view taken along a lamp axis Z of an embodiment of the invention.
Figure 2:
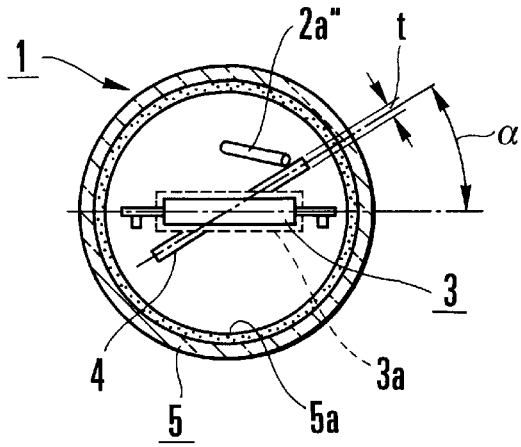
FIG. 2 illustrates a cross sectional view taken along line A—A of FIG. 1.

FIG. 1 illustrates a cross sectional view taken along a lamp axis Z of an embodiment of the invention, and FIG. 2 illustrates a cross sectional view taken along line A—A of FIG. 1.

Fluorescent lamp 1 can include: a bulb 5; fluorescent material 5*a* coated on an internal surface of the bulb 5; a stem 2; a discharge chamber 5*b* filled with gas and mercury; lead wires 2*a*, 2*a*', and 2*a*" passing air-tightly through the stem 2; a thermal cathode filament 3 supported by the lead wires 2*a* and 2*a*'; electron emitting material 3*a* coated on the cathode filament 3; and, an anode 4 supported by the lead wire 2*a*". The anode 4 can be a substantially rectangular plate having a smaller thickness (t) than that of the ring-like anode 93 as found in related art fluorescent lamps.

One side 4*a* of the rectangular anode 4 faces towards the thermal cathode filament 3 and is parallel to the thermal cathode filament 3 in a cross sectional view taken along a longitudinal length of the rectangular anode plate 4, as shown in FIG. 1. The thermal cathode filament 3 resides in a plane which is perpendicular to the bulb axis Z.

As shown in FIG. 2, in a cross sectional view along line A—A of FIG. 1, the line A—A crosses the lamp axis Z at a right angle. From the perspective of FIG. 2, the angle $\alpha$ between the side 4*a* and the thermal cathode filament 3 can be within an angle range of 30–60 degrees. The lead wire 2*a*" can be attached to the rectangular anode plate 4 by soldering or welding, e.g., spot welding, such that the anode 4 and the lead wire 2*a*" are in a flag-shaped configuration. An upper end of the lead wire 2*a*" can be configured such that it terminates prior to reaching the side 4*a* of the anode 4. In other words, the lead wire 2*a*" preferably does not exceed an upper end of the rectangular anode plate 4 and does not project in the discharge chamber 5*b* toward the thermal cathode filament 3. The rectangular anode plate 4 can have a surface coated with mercury alloy, and another surface coated with a getter material such as Zirconium or Aluminum. The mercury alloy and the getter material can be painted onto the anode 4.

The advantages of the fluorescent lamp 1 according to the invention will now be described. First, because the thickness (t) of the rectangular anode plate 4 is smaller than that of the related art, a stronger electric field can be applied. Accordingly, a smaller discharge spot is obtained on the thermal cathode filament 3, and the temperature of the cathode spot is increased, enabling improvement of thermal electron emission efficiency. Because thermal electron emission can occur in larger quantity, ultraviolet rays can also be emitted in a larger quantity than related art fluorescent lamps. Therefore, a brighter fluorescent lamp 1 with improved efficiency is provided.

Figure 5:
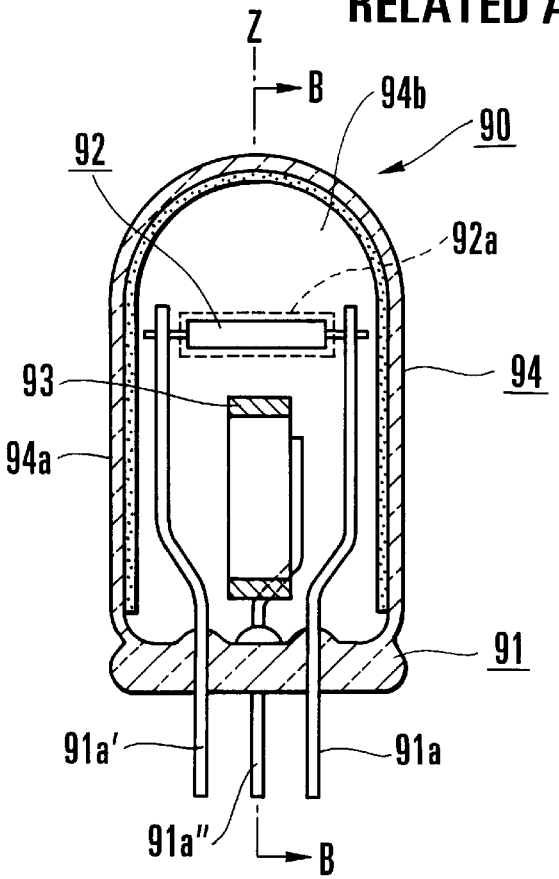
FIG. 5 RELATED ART
FIG. 5 illustrates a cross sectional view taken along a lamp axis Z of a related art fluorescent lamp.
Figure 6:
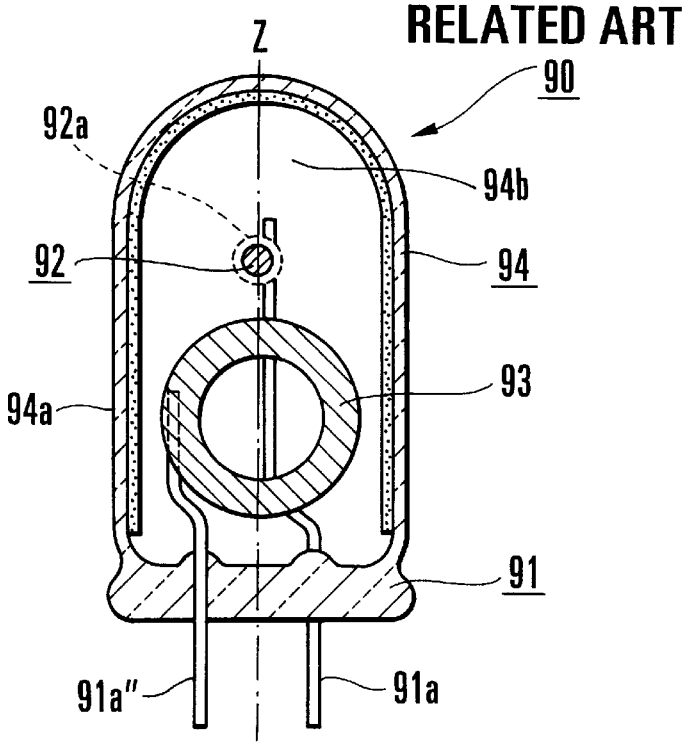
FIG. 6 illustrates a cross sectional view taken along line B—B of the related art fluorescent lamp of FIG. 5.
Figure 7:
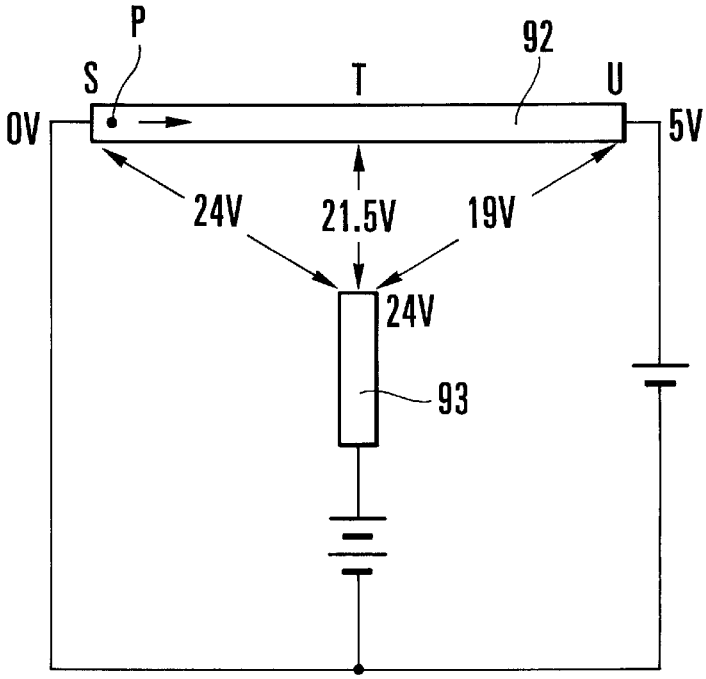
FIG. 7 is a diagram showing position shift of a discharge spot on a thermal cathode filament of a related art fluorescent lamp.

In addition, as the time of operation of the light increases, the discharge spot P on the thermal cathode 3 moves from the grounded end S to end U on the positive side of the thermal cathode. As the discharge spot P moves, the distance between the discharge spot P and the rectangular anode plate 4 is smaller than in related lamps because, in a cross sectional view of the fluorescent lamp 1 perpendicular to the bulb axis Z, the angle between the thermal cathode 3 and the rectangular anode 4 can be in a range of 30–60 degrees. By contrast, the thermal cathode 92 of a related art fluorescent lamp as shown in FIGS. 5 and 6 substantially crosses the ring-like anode 93 at a right angle.

Furthermore, because the lead wire 2*a*" does not project above anode 4 toward the thermal cathode filament 3, discharge occurs between the thermal cathode filament 3 and the anode 4. Thus, discharge from the upper end of the lead wire 2*a*" can be prevented and more stable discharge can be achieved.

Figure 3:
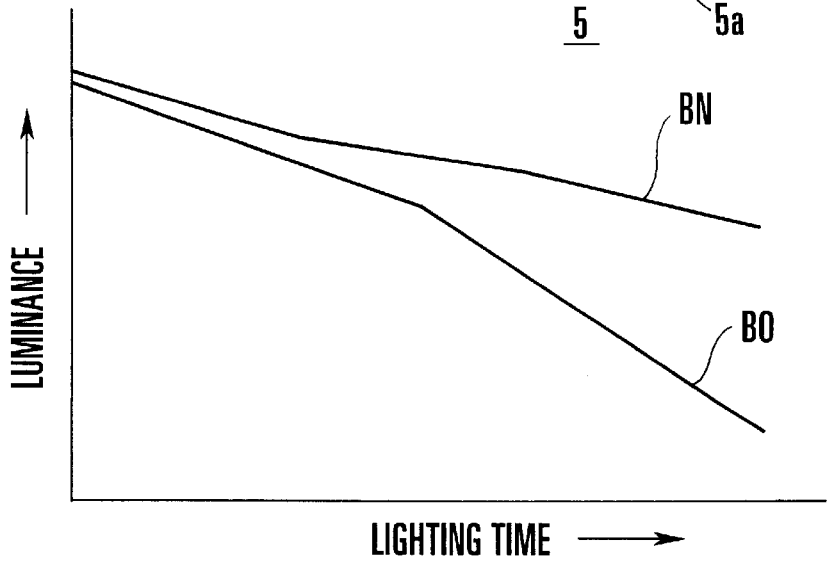
FIG. 3 is a graph showing luminance characteristics as a function of lighting time of both the embodiment of the invention shown in FIG. 1 and of a related art lamp.

As shown by line BN of FIG. 3, the luminance of the fluorescent lamp 1 decreases gradually and remains at a high level after the discharge spot passes the center of the thermal cathode filament 3 as compared with the line BO, which shows luminance characteristics of the related art fluorescent lamp 90.

Because the anode 4 can be a substantially rectangular plate, it is easy to form and manufacture. The process for formation of the anode 4 can include cutting a metal plate with a press machine. The metal plate can be a standard nickel plate ordinarily used in the lighting art.

The invention also provides more flexible design possibilities. Specifically, over-all size reduction and diameter reduction of the fluorescent lamp are possible while maintaining sufficient mercury alloy levels in the lamp. For example, when it is necessary for anode 4 to have an area of at least 15 $mm^2$ for the fluorescent lamp 1 to have a sufficient quantity of mercury alloy, typical rectangular dimensions of the anode 4 can be as follows; 2×7.5 mm, 2.5×6 mm, 3×5 mm, 3.5×4.3 mm, or 4×3.8 mm. The length of side 4*a* of the rectangular anode plate 4 that faces towards the thermal cathode filament 3 can be any of the dimensions set forth above. Therefore, the shape and dimension of side 4*a* are determined depending on an internal diameter of the bulb 5.

Figure 4:
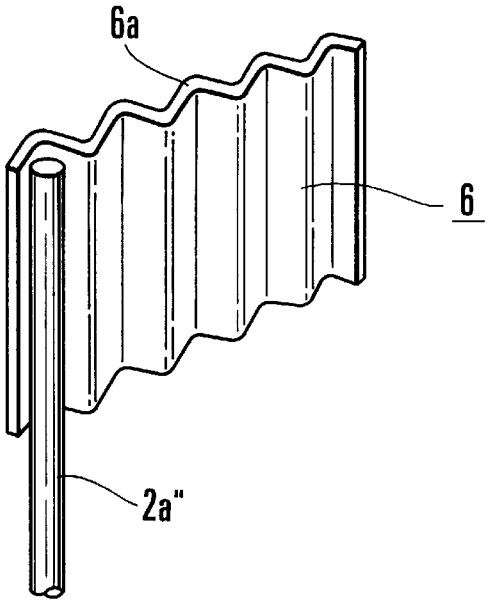
FIG. 4 illustrates a perspective view of the anode, and the lead wire supporting the anode, of another embodiment of the invention.

FIG. 4 illustrates a perspective view of an anode 6 according to another embodiment of the invention. In this embodiment, the anode 6 is a substantially rectangular plate in a cross sectional view taken along the bulb axis Z. In a cross sectional view perpendicular to the bulb axis Z, a side 6*a* of the anode 6 can be configured as a continuous set of waves, each wave having the same height and length. If the surface areas of the rectangular anode plate 4 of the embodiment of the invention shown in FIGS. 1 and 2 and the anode 6 of the embodiment shown in FIG. 4 are the same, anode 6 can have a smaller projected area than anode 4. Accordingly, anode 6 allows for still further reduction in over-all size of the fluorescent lamp 1.

It will be apparent to those skilled in the art that various changes and modifications can be made in the fluorescent lamp of the invention without departing from the spirit and scope of the invention. For example, the anode plate can be made of various shapes and include various "wave" shapes in its cross-section, e.g., sinusoidal, square or triangular waves. Thus, it is intended that the invention cover the modifications and variations of this invention provided they come within the scope of the appended claims and their equivalents.

What is claimed is:

1. A fluorescent lamp comprising:

a bulb having an internal surface defining a discharge chamber;

a fluorescent material coated on said internal surface of said bulb;

a stem located in said bulb and filled with gas and mercury;

a thermal cathode filament coated with electron emitting material and supported in said discharge chamber by a pair of lead wires; and an anode supported in said discharge chamber by an anode lead wire, wherein said anode is a substantially rectangular plate, and one side of said rectangular anode plate is parallel to a plane including the thermal cathode filament;

said thermal cathode filament and said rectangular anode are arranged in a rotated position relative to each other within an angle range of 30–60 degrees on a parallel flat surface; and said rectangular anode plate and said anode lead wire are attached to each other and configured in a substantially flag-shape, and an upper end of said anode lead wire is located on the rectangular anode plate such that it does not exceed an upper end of a side of the rectangular anode which faces the thermal cathode filament, and does not project into the discharge chamber toward the thermal cathode filament.

2. The fluorescent lamp according to claim 1, wherein said rectangular anode plate has a substantially wave-shaped cross-section on said side which faces the thermal cathode filament.

3. A lamp comprising:

a bulb having a top portion, a base portion and an internal surface defining a discharge chamber;

a stem located at said base portion of said bulb;

a thermal cathode located in the discharge chamber and supported by a first cathode lead wire; and an anode located in the discharge chamber and supported by an anode lead wire, wherein said anode has one side that is parallel to a plane including the thermal cathode, said thermal cathode and said anode are positioned at an acute angle with respect to each other when viewed from said top portion of said bulb, and said anode and said anode lead wire are connected together such that said anode lead wire has an upper end that terminates prior to exceeding an upper side of said anode which faces said thermal cathode.

4. The lamp according to claim 3, wherein said anode is formed as a substantially rectangular plate.

5. The lamp according to claim 3, wherein said anode has a substantially wave-shaped cross-section on a side facing said thermal cathode filament.

6. The lamp according to claim 5, wherein said substantially wave-shaped cross-section includes a plurality of waves, each having substantially identical amplitude and substantially identical length.

7. The lamp according to claim 5, wherein said substantially wave-shaped cross-section includes a sinusoidal shaped wave shape.

8. The lamp according to claim 3, wherein said discharge chamber includes gas and mercury.

9. The lamp according to claim 3, further comprising:

a second lead wire supporting the thermal cathode.

10. The lamp according to claim 3, wherein said internal surface of said bulb includes a fluorescent material located thereon.

* * * * *